US012736057B2

(12) United States Patent
Bini et al.

(10) Patent No.: US 12,736,057 B2
(45) Date of Patent: Sep. 15, 2026

(54) COMPRESSOR WITH INTEGRATED SPEED MULTIPLIER

(71) Applicant: TURBODEN S.P.A., Brescia (IT)

(72) Inventors: Roberto Bini, Brescia (IT); Mario Gaia, Brescia (IT); Davide Colombo, Brescia (IT); Antoine Guitton, Brescia (IT); David Pasquale, Brescia (IT); Mauro Piazza, Brescia (IT)

(73) Assignee: TURBODEN S.P.A., Brescia (IT)

( * ) Notice: Subject to any disclaimer, the term of this patent is extended or adjusted under 35 U.S.C. 154(b) by 0 days.

(21) Appl. No.: 19/146,649

(22) PCT Filed: Jan. 4, 2024

(86) PCT No.: PCT/IB2024/050076
§ 371 (c)(1),
(2) Date: Jul. 9, 2025

(87) PCT Pub. No.: WO2024/150086
PCT Pub. Date: Jul. 18, 2024

(65) Prior Publication Data

US 2026/0226904 A1 Aug. 6, 2026

(30) Foreign Application Priority Data

Jan. 10, 2023 (IT) ..... 102023000000138

(51) Int. Cl.

| | |
|---|---|
| ***F04D 25/02*** | (2006.01) |
| ***F04D 17/12*** | (2006.01) |
| ***F04D 29/063*** | (2006.01) |
| ***F04D 29/12*** | (2006.01) |

(52) U.S. Cl.
CPC ..... *F04D 25/02* (2013.01); *F04D 17/12* (2013.01); *F04D 29/063* (2013.01); *F04D 29/124* (2013.01)

(58) Field of Classification Search
CPC ..... F04D 25/16; F04D 25/02; F04D 29/06; F04D 29/063; F04D 17/12
See application file for complete search history.

(56) References Cited

U.S. PATENT DOCUMENTS

| | | | | |
|---|---|---|---|---|
| 4,687,411 A * | 8/1987 | Maeda | F16C 35/02 | 384/538 |
| 6,018,962 A * | 2/2000 | Dewhirst | F16H 57/0458 | 62/468 |
| 6,517,311 B2 * | 2/2003 | Funke | F04D 29/122 | 415/105 |

OTHER PUBLICATIONS

Zhu, Wen-Qiang et al., "A Single Stage High Speed Centrifuge Blower," to CPO, CN 206468546, Sep. 5, 2017 (Year: 2017).*

(Continued)

*Primary Examiner* — Nathaniel E Wiehe
*Assistant Examiner* — Joshua R Beebe
(74) *Attorney, Agent, or Firm* — R. Ruschena Patent Agent, LLC

(57) ABSTRACT

A compressor, in particular, a compressor used in heat pump systems and/or refrigeration systems, in which the compressor fluid is in direct contact with the bearings and gears of the gearbox which drives the compressor. Particularly multi-shaft, provided with an integrated speed multiplier, having a single seal on the slow gear shaft with negligible loss of compressor fluid to the atmosphere and/or no entry of barrier fluid into the process.

19 Claims, 8 Drawing Sheets

(56) References Cited

OTHER PUBLICATIONS

Pruemper, Heinrich, "Gear Driven Compressor for the Compression of Oxygen," to the EPO, EP 0653566 B1, Dec. 23, 1998 (Year: 1998).*

* cited by examiner

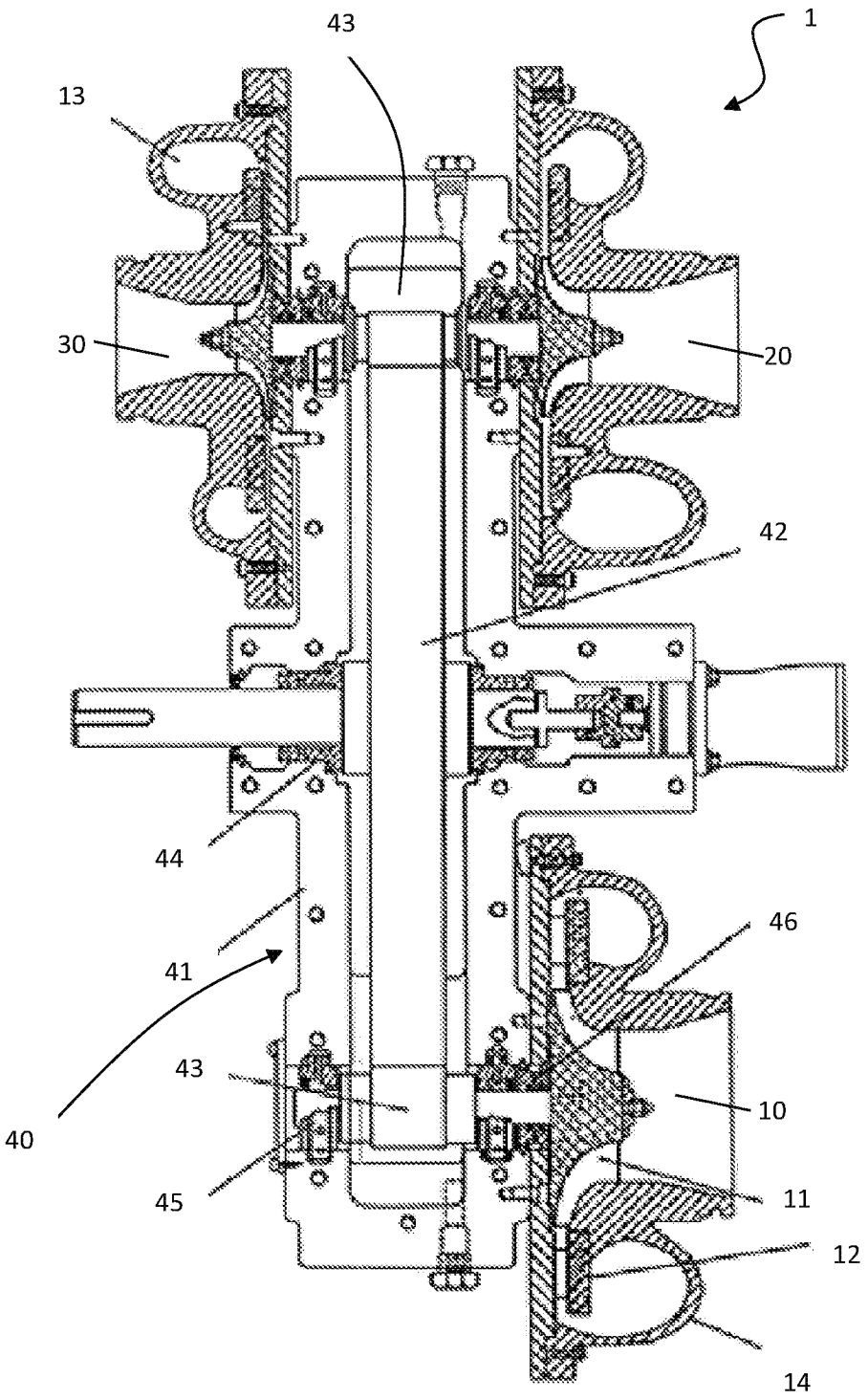
Fig. 1 – Prior art

COMPRESSOR WITH INTEGRATED SPEED MULTIPLIER

RELATED APPLICATIONS

This is a national stage application of PCT application PCT/IB2024/050076 having an international filing Date of Jan. 4, 2024. This application claims foreign priority based on application 102023000000138 of Italy, filed on Jan. 10, 2023.

BACKGROUND OF THE INVENTION

1. Field of the Invention

The present invention relates to a compressor, in particular, a compressor used in heat pump systems and/or refrigeration systems, in which the compressor fluid is in direct contact with the bearings and gears of the gearbox which drives the compressor.

2. Brief Description of the Prior Art

As is known, a compressor is an operating machine capable of increasing the pressure of a compressible fluid (gas or vapors) using mechanical energy. Among the various types of compressors used in industry there are the so-called centrifugal compressors, in which energy is transferred to the gas in the form of centrifugal acceleration due to rotation, generally imposed by a prime mover (electric motor, steam turbine or gas and related transmission mechanism) to a member called rotor. The rotor is made up of one or more bladed wheels, called impellers, rigidly connected to a shaft supported by bearings.

Centrifugal compressors can be equipped with a single impeller, in the so-called single-stage configuration, or with multiple impellers and, in this case, we are referring to multi-stage compressors. When the impellers are rigidly connected to one or more shafts with a toothing driven by a common gear connected to an electric motor, a turbine or in general a drive system, this configuration is called compressor with integrated speed multiplier or IGC (acronym from "Integral Gear Compressor").

Compressors with integrated speed multiplier are machines in which in the speed multiplier case there is a shaft, connected to the prime mover, which carries a central gear. The central gear rotates at a slow speed and meshes with at least one pinion (smaller toothed wheel which therefore rotates at a higher speed) made on a corresponding shaft of the compressor. The rotation motion is thus transferred from the pinion to at least one impeller. The number of pinions and the relative number of impellers is variable based on the application, for example it can be equal to two (two-stage compressors). In some cases, idler gears are interposed between the central gear, called wheel, and the pinions.

In this type of compressor, for each pinion it is possible to create a perfect combination of rotation speed and impeller diameter which optimizes the compressor design. All the impellers are cantilevered and can be equipped with a pre-rotation device (a set of stator blades that form spaces whose section and orientation can be varied) located upstream of the impeller itself. Interstage cooling of the gas flow can be carried out on the discharge of each individual impeller.

The combination of these features allows for high flow rates, exceptional compression efficiency, even at partial load, all in a compact design.

FIG. 1 shows a typical configuration of a compressor with integrated speed multiplier 1, as reported in the AP1617 ("American Petroleum Institute") standard relating to centrifugal compressors. The illustrated compressor is a three-stage compressor and is provided with a first stage inlet 10, a second stage inlet 20 and a third stage inlet 30. Furthermore, each stage has an impeller 11, a diffuser 12 and a volute of exhaust 13 inside a casing 14. The speed multiplier 40 is provided with a case 41 and includes a slow wheel 42, pinions (in this case two in number) 43, bearings 44 to support the slow wheel and bearings 45 to support the pinions. In order to separate the multiplier case from the working fluid (the pressurized gas processed by the compressor), appropriate rotating seals 46 are provided for each pinion 43.

Among the limits imposed by the architecture of the compressor with integrated IGC speed multiplier, there is the need to mount numerous seals 46, each corresponding to the penetration of the pinion 43 into the pressurized casing 14 of the compressor, so as to limit or even eliminate the leak of process gas towards the case 41 of the speed multiplier 40, in turn connected to the atmospheric pressure.

In a typical configuration based on a single pinion seal, each seal minimizes the loss of compressor fluid to the case where the gears are housed, making it possible to collect gas in a vent chamber without pressurizing the speed multiplier case, that remains at atmospheric pressure.

The gas collected in the vent chamber, depending on its chemical composition, can represent a potential source of harmful emissions and is therefore generally discharged into the atmosphere through a special chimney or burned in the plant torch. In other typical configurations, the sealing system is composed of a "double" seal with a barrier fluid (e.g. nitrogen) between the two seals and at a pressure always higher than the working fluid pressure. In addition to be expensive and axially very bulky, double gas seals often have intolerable characteristics, such as the continuous entry of the barrier fluid into the process gas.

While in most cases this leakage is not a problem, in others (particularly closed loop heat pump applications) a barrier fluid entering the process side is very detrimental to system performance, the barrier fluid being, typically nitrogen, a non-condensable gas.

Whatever the solution adopted and the sophistication of the seal used, it is not possible to avoid the loss of working fluid or the entry of barrier fluid into the process. Therefore, in applications where negligible leakage of fluid towards the gearbox casing is required or where contamination of the working fluid by the barrier fluid is desired, the configuration of the compressor with integrated speed multiplier is not effective. Other known solutions adopted especially on single-shaft machines are:

- mount all the stages on a single shaft equipped with a single seal installed in correspondence with the penetration of the shaft into the pressurized box. In this case the shaft can be coupled to a drive, for example an electric motor with gearbox, located outside the area pressurized by the process gas,
- alternatively remove all seals and enclose gears and prime mover drive in a sealed compartment pressurized with compressor fluid. These solutions are typical of compressors for heat pumps and for the refrigeration industry which have a single shaft that carries the compressor impellers. However, the compressor having a single shaft, with the compressor wheels mounted cantilevered or between the bearings, does not allow the performance and compactness of the compressor with integrated speed multiplier, described previously, to be achieved.

On the other hand, with IGC integrated gearbox compressors it is difficult to design a pressurized case (even at pressures of a few bars) that can accommodate multiple shafts and bearings and at the same time have the ability to resist pressure forces while maintaining a precise relative position of the shafts and gears, i.e. with acceptable deformations.

What has been said is further supported by the fact that, according to the known art, the casing of a compressor with integrated speed multiplier having more than one shaft is made, according to the known art, from flat plates which by their nature poorly withstand pressure and in any case present unacceptable deformations if subjected to internal pressure. Since the case is the structure that supports and positions the shaft bearings, which in turn determine the correct alignment of the gears, a misalignment of the pinions, for example caused by the deformation of the case subject to internal pressure, can produce incorrect contact on the teeth of the gear resulting in vibrations and reduction of the useful life of the gears. Ultimately and according to known techniques, for these reasons compressors with a pressurized gearbox are limited to applications with a single shaft and with cylindrical shaped cases, while multi-shaft compressors have an atmospheric pressure case with seals on each pinion.

There is, therefore, a need for a compressor design solution with integrated speed multiplier that resolves or at least mitigates the above-mentioned drawbacks.

SUMMARY OF THE INVENTION

An object of the present invention is to provide a solution of a compressor, particularly multi-shaft, provided with an integrated speed multiplier, having a single seal on the slow gear shaft with negligible loss of compressor fluid to the atmosphere and/or no entry of barrier fluid into the process. Naturally, this solution can also be applied to a single-stage application, in other words, with a speed multiplier having a single pinion and a single impeller.

According to this solution, the gearbox case will have to withstand a pressure linked to the presence of the working fluid coming from the different stages of the compressor. For this purpose, the gearbox case includes a frame that supports pinions and bearings, located inside an external containment shell with the function of containing the pressure of the process gas. In this way the internal frame is perfectly balanced with respect to the pressure of the fluid and can be made with flat plates without risk of excessive deformations.

Furthermore, is also necessary and foreseen a flexible element which allows the expansion of the pressure containment shell, when this is subject to deformation, without exerting excessive forces on the internal frame which supports the bearings (which instead will remain substantially undeformed), thus maintaining the position of the shafts within tolerance regardless of the pressure level inside the gearbox case.

According to one aspect of the present invention, a compressor is therefore described, provided with an integrated speed multiplier and having the characteristics set out in the independent product claim attached to the present description.

Further preferred and/or particularly advantageous ways of implementing the aforementioned system are described according to the characteristics set out in the attached dependent claims.

BRIEF DESCRIPTION OF THE DRAWINGS

The invention will now be described with reference to the attached drawings, which illustrate some non-limiting examples of implementation of the invention, in which:

FIG. 1 illustrates, in cross section, a compressor equipped with an integrated speed multiplier, according to the known art, FIGS. 2*a* and 2*b* schematically illustrate, according to a partial longitudinal section and a front view, a compressor equipped with an integrated speed multiplier, according to a preferred embodiment of the present invention.

DETAILED DESCRIPTION OF THE PREFERRED EMBODIMENTS

Figure 2A:
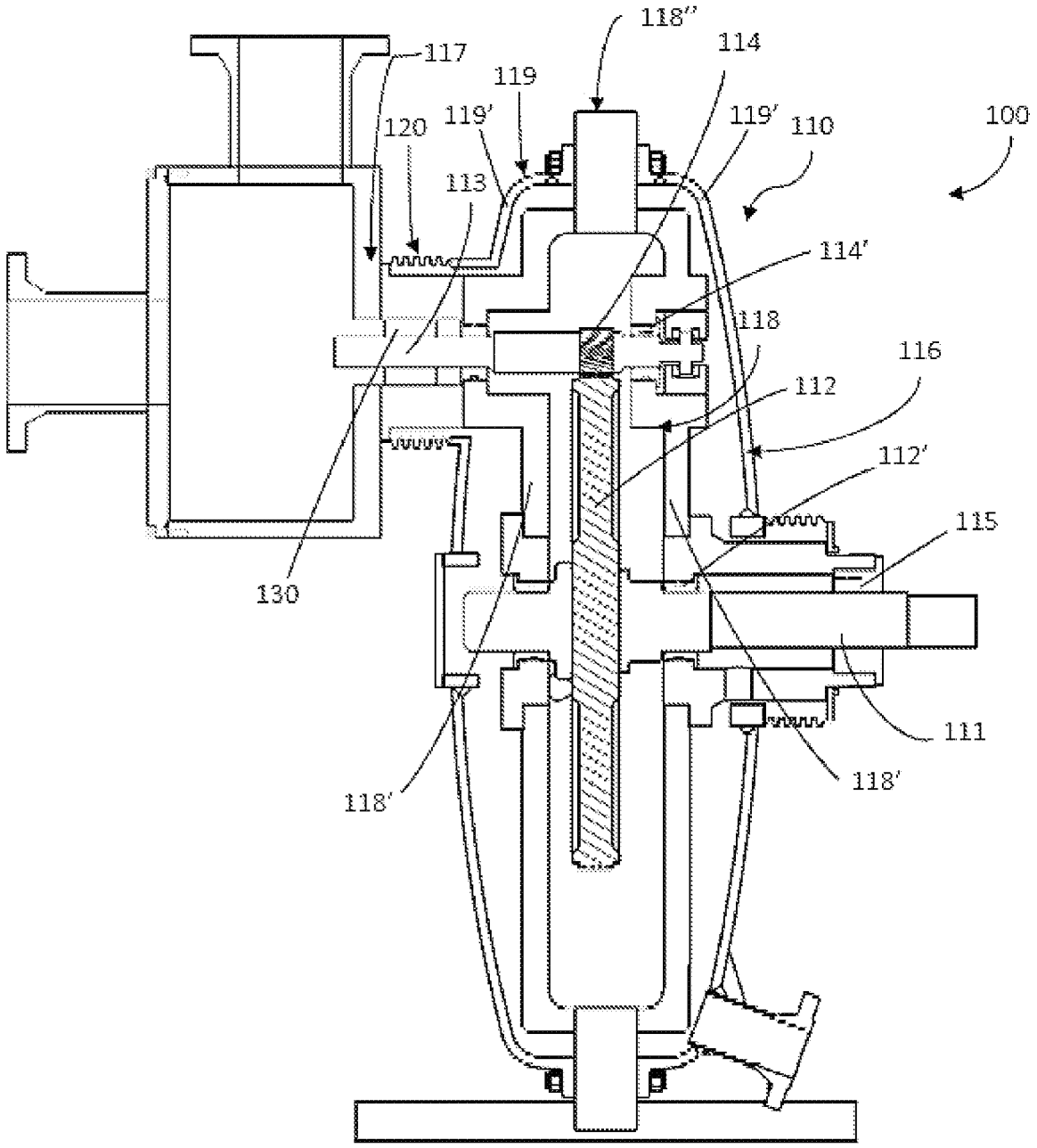
Figure 2B:
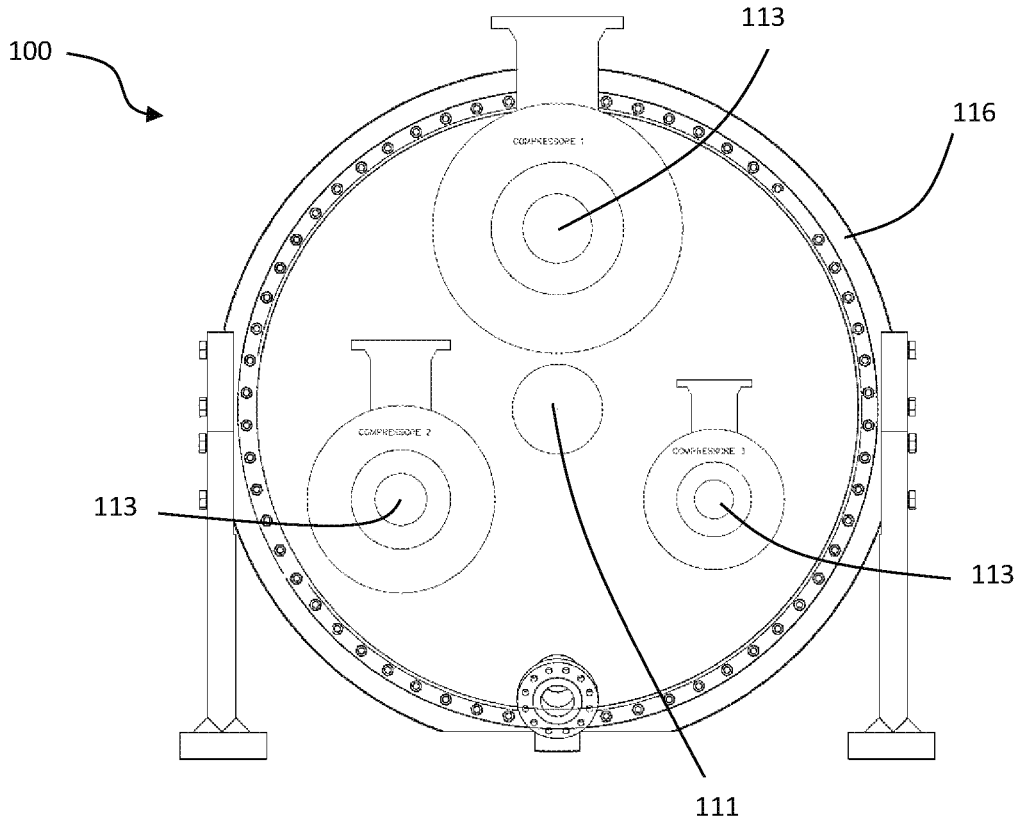

Referring to FIGS. 2*a* and 2*b*, the compressor equipped with an integrated speed multiplier, according to a preferred embodiment of the present invention, is indicated with the reference 100.

In this exemplary embodiment, the compressor is multi-stage with pinion shafts arranged circumferentially around a slow wheel, and one or two impellers mounted on each pinion. It should be noted that the compressor could also be equipped with a single pinion.

For simplicity of representation, all the stages of the compressor connected to the pinions 114 are not shown in FIG. 2 (as they are of a known type and in any case similar to what is illustrated in FIG. 1) while the integrated speed multiplier 110 is schematized.

The speed multiplier 110 includes:

- a first 'slow' shaft 111, connected to a prime mover (of a known type and therefore not illustrated) which carries a toothed gear 112 (in English 'bull gear'), which rotates at low speed, i.e. at the speed of the prime mover. For example, the rotation speed of the first shaft 111 and the gear 112 could be between 1000 rpm and 3600 rpm;
- at least a second shaft 113 carrying a pinion 114. The at least one second shaft 113 is arranged circumferentially around the toothed gear 112. The pinion 114, of smaller diameter than the toothed gear 112, meshes with the latter, causing the rotation of the second shaft 113 at a speed greater than the rotation speed of the first shaft 111, a speed evidently determined by the ratio of the number of teeth between the toothed gear 112 and the pinion 114. The second shaft 113 is in turn connected with one or more impellers (not illustrated) of the compressor 100. Preferably, as in the embodiment described, the speed multiplier 110 is provided with up to four shafts 113 and, therefore, with four pinions 114, arranged circumferentially with respect to the toothed gear 112, but the number of pinions 114 and shafts 113 could also be equal to one, the number being linked to the head that the compressor must process and the size of the scrolls arranged circumferentially around the wheel 112. Both the toothed gear 112 and the pinions 114 can be gears of the helical or straight tooth type. Depending on the applications, idler gears may be installed between the gear 112 and the pinions 114. The toothed gear 112 and the relative shaft 111 are supported by bearings 112' (in FIG. 2 only the one to the right of the toothed gear 112 is highlighted), just as the pinion 114 and the relative shaft 113 are supported by corresponding bearings 114' (in the FIG. 2 only the one to the right of the toothed gear 114 is highlighted). The bearings can be of the oscillating stud or bushing type or of the rolling type; —a mechanical seal 115, located on one end of the low-speed shaft 111, connected to the compressor drive. If the speed of the shaft 111 is between 1000 rpm and 3600 rpm, this will therefore be a typical seal for most rotating machines such as pumps and turbines. The seal is oil lubricated and can be either single or double. The double seal may also contain a barrier fluid, such as nitrogen or oil.

The advantage of having the seal on the shaft with a lower rotation speed is to obtain a strong and rigid shaft with an acceptable peripheral speed on the seal. In fact, the sliding speed between the rotor ring and the stator ring of the seal is proportional to the angular rotation speed times the diameter while the rigidity is proportional to the diameter raised to the fourth power. This simple consideration clarifies the need to mount the seal on the shaft at lower revolutions to have a sufficiently robust shaft associated with a peripheral speed of the seal compatible with negligible fluid losses. Furthermore, a possible loss of this seal has absolutely negligible effects as it does not interact with the process as would happen with the loss of a possible rotating seal placed on a pinion to which a stage of the compressor is connected.

Figure 3:
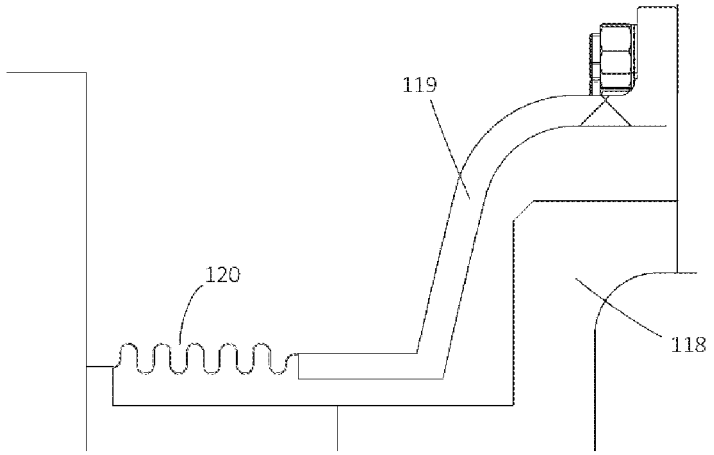
FIG. 3 is an enlarged detail of the compressor in FIG. 2.

The speed multiplier 110 also includes:

a casing 116 capable of containing the shafts 111, 113, the gears 112, 114, the bearings 112', 114' as well as the working fluid and resisting the relative pressure, with the possibility of mounting more than one pinion 114, preferably three spaced 120° apart. The casing 116 in turn includes a frame 118 inside a pressure containment shell 119 and a flexible element 120. In particular:

the frame 118 supports the first shaft 111, the gear 112 and the related bearings 112' as well as the second shafts 113, the pinions 114 and the related bearings 114', and is connected via an interface element 117, for example a flange compressor support, to the compressor casing (internal compressor components not shown in the figure). The frame 118 includes two half frames 118' of which at least one of the two is bolted to a central ring 118" (for assembly needs) connected to the compressor base. The frame 118 is completely inside the pressure containment shell 119, except for the central ring 118". The frame 118 is provided with circumferential openings to allow the collection of the lubricating oil in the lower part of the pressure containment shell 119. The oil is discharged from the lower part of the shell 119 and is conveyed to a pressurized oil control unit, for example connected to the first suction of the compressor, via a pipe with flexible bellows. On the frame 118, the supporting flanges of the compressor casing or more generally the interface elements 117, which support the casing of the compressor stages, and any seals 130 on the shaft 113 are rigidly connected (for example, bolted or welded) between impellers and speed multiplier 110. These seals 130, which can be labyrinth 121 or even labyrinth and oil 206, will be described in detail with reference to FIGS. 4 and 5 respectively. The frame 118 can accommodate one or more flanges 117 (for example three), on which the corresponding compressor stage cases will be mounted, a containment shell 119 with a pressure containment function. The frame 118 is inside the containment shell 119 and in this way the frame 118 is perfectly balanced with respect to the pressure of the fluid and can be made with flat plates without risk of excessive deformations. The containment shell 119 can be formed by two half-shells 119' which in turn are flanged to the central ring 118". The two half-shells 119', for example, can be divided along a vertical center plane and be made with rounded bottoms, for example of the toroidal or elliptical or flat type. A gasket, such as an O-ring, may be used to seal the shell flange 119 to the internal frame ring 118. A plurality of connecting means (for example, bolts) firmly hold the gasket and bottoms in place subject to gas pressure (pressure which, for example, can reach 10 or more bar). Advantageously, the pressure containment shell 119 has openings closed by removable covers in correspondence with the bearings 112', 114' and for the inspection of the gears (gear 112, pinions 114) and maintenance of the bearings;

a flexible element 120, for example a bellows or a flexible diaphragm, placed between the interface element 117 and the pressure containment shell 119. Also referring to FIG. 3, the flexible element 120 allows the pressure containment shell 119 to deform due to the effect of the internal pressure without transmitting excessive forces to the interface element 117 (i.e., to the compressor support flange) which could cause distortion to the internal frame 118 that supports the bearings. In this way, the position of the first shaft 111 is maintained within tolerance regardless of the pressure level inside the casing 116. In other words, the flexible element 120 decouples the frame 118 from the shell 119, effectively eliminating the deformation of the frame 118 due to the pressure to which the shell 119 is subjected, allowing the correct meshing between the pinions 114 and the wheel 112 to be maintained as well as avoiding relative movements between the stator parts and the rotor parts of the compressor due to the effect of said pressurization. The flexible element 120 is mounted with a gasket to prevent gas leakage from the pressurized shell 119. Alternatively, the flexible element can be welded both on the interface element 117 and on the shell 119 to avoid leakage of fluid into the atmosphere.

Advantageously, the speed multiplier 110 is also provided with seals 130, downstream of the compressor impellers and accommodated on each shaft 113 which carries the pinion 114, between the corresponding impeller and the speed multiplier. These seals 130 limit the leakage of fluid processed by the compressor (process fluid) towards the casing 116 of the speed multiplier 110. In particular, the seals 130 are mounted between the interface element 117 and the pinion 114.

A specific diagram of the lubrication circuit of the seals has been developed for the mechanical seal 115 and for the seals 130 used in the speed multiplier. Let us consider, by way of example, the case in which in addition to the mechanical seal 115 on the first shaft 111, the seals 130 are also present.

While the mechanical seal 115 on the first shaft 111, the slow shaft, has the function of minimizing the loss of working fluid outside the compressor and the integrated speed multiplier 100, therefore towards the external environment, the seals 130 are used to minimize the flow of working fluid inside the casing 116 of the speed multiplier 110, therefore they are seals that limit the flows inside the machine. A reduced flow is advantageous for the efficiency of the compressor and, furthermore, reduces the amount of fluid that is pressurizing the gear casing 116 and the mixing between the lubricating oil present in the casing 116 and the process fluid, which in the case of a heat pump is typically an organic fluid. The casing 116 is in fact pressurized by the working fluid and its pressure level depends on the inlet flow rate and the flow rate that is extracted from said tank in the gaseous phase, for example through a duct connected to a volume with lower pressure, possibly for by means of a compressor or an ejector system: an equilibrium is therefore achieved which determines a certain concentration of process fluid in the lubricating oil, a concentration which is best kept at the lowest possible levels so as not to excessively modify the lubrication characteristics of the oil. Furthermore, a reduced pressure level in the gearbox improves efficiency by reducing ventilation losses and improves lubrication of gears and bearings by reducing foaming and solubilization of the process fluid in the oil which causes a reduction in viscosity.

Some possible forms of implementation of the lubrication and sealing system are described below, the choice of which will depend on the particular application.

Figure 4:
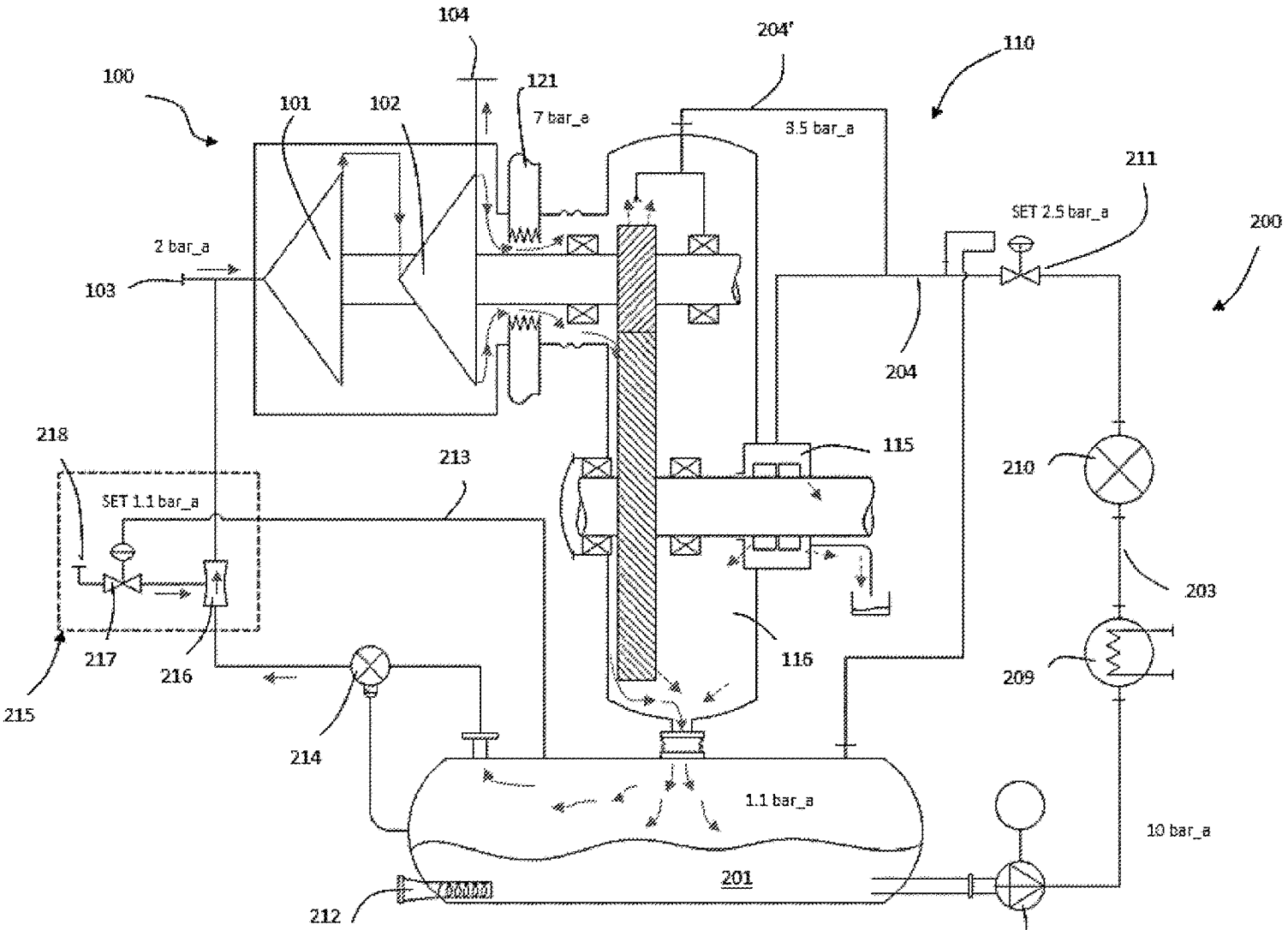
FIG. 4 is a simplified basic diagram of the lubrication and sealing system for the compressor of FIG. 2, according to a first embodiment.

FIG. 4 shows a simplified basic diagram of the lubrication and sealing system, according to a first embodiment. In this figure as well as in the following figures from 5 to 8, the paths of the working fluid of the compressor are schematized with solid line arrows, while the paths of the lubrication oil are schematized with discontinuous line arrows. Furthermore, when describing the different components, the expressions "downstream of" or "upstream of" will be used, having as reference the travel direction of the working fluid or lubrication oil.

This first embodiment of the lubrication and sealing system is suitable for applications in which the pressure in the compressor is relatively low, for example less than 10 barA, as the oil tank is in fluid connection with the compressor.

FIG. 4 shows the compressor 100 schematically, provided by way of example with two impellers 101, 102, respectively for the first compression stage and for the second compression stage mounted on the same shaft 113, an intake line or duct 103 upstream of the first impeller 101 and a delivery line or duct 104 downstream of the second impeller 102. In the same FIG. 4 the speed multiplier 110 is schematized with the seal 115 towards the external environment and at least one internal labyrinth seal 121.

Furthermore, in FIG. 4 a lubrication and sealing system 200 is illustrated, with oil lubrication, which includes:

an oil tank 201, at a pressure slightly higher than the suction pressure of the first stage of the compressor, for example 2.1 bar compared to 2 bar of the suction line 103, in the absence of a depressurization system. Conversely, the pressure in the tank can be appropriately reduced, for example to a value of 1.1 barA (as indicated in FIG. 4), if a depressurization system is present, be it volumetric or dynamic as shown in FIG. 4 and as will be described below.—an oil pump 202, downstream of the tank 201 and in fluid communication with it, which further pressurizes the oil, for example at a pressure of 10 bar, an oil conditioning system, composed of a thermostated refrigerant system 209, downstream of the pump 202, and of a filtering system 210, located downstream of the refrigerant system 209, an oil pressure regulation system 211 of a differential type with respect to the pressure present in the oil tank which is equalized with the discharge of the speed multiplier 110, a delivery branch 203 from the oil pump 202, which is divided into a first supply branch 204 of the oil to the mechanical seal 115 and a second supply branch 204' which distributes the oil to the bearings and sprayers for gear lubrication.

The oil together with the working fluid that leaks from the labyrinth seal 121 is conveyed by gravity to the lower part of the casing 116 of the speed multiplier 110 and from here to the tank 201 where the separation between the liquid and gaseous phases takes place. To promote separation, the tank is not filled completely, maximizing the free surface of the liquid and is equipped with devices that promote separation between liquid and vapor, for example septa and heaters 212.

The vapors, whether they relate to the working fluid or to the oil, are conveyed along the return line 213 which connects the tank 201 to a low-pressure system area, for example the suction line 103 of the compressor 100. Along the return line 213 could advantageously include a separation system, for example a demister 214 to eliminate any liquid particles entrained by the fluid flow, and the aforementioned depressurization system 215 comprising a mechanical or dynamic compressor. The figure shows an ejector 216 and the related control system which in the simplest form can be made up of a regulator 217 which modulates the driving fluid 218 of the ejector 216 according to the pressure required in the tank 201, for example 1.1 barA as indicated in FIG. 4.

The scheme described in FIG. 4 could present an intrinsic limitation due to the difficulty of reducing gas leakage through the labyrinth seal 121 as the pressure in the compressor 100 increases. Although it is possible to increase the pressure in the lubrication system consistently with the pressure of the compressor, it is not advisable for technological reasons (related, for example, to the thicknesses required for the tank and the pump) and/or related to the properties of the lubricating oil, to increase the pressure in the tank beyond 5-10 barA.

High leakage from the labyrinth seal 121 could have impacts on the thermodynamic performance of the compressor and on the sizing of the separation system downstream of the tank, as the flow tends to drag the oil drops and its vapors towards the process.

Figure 5:
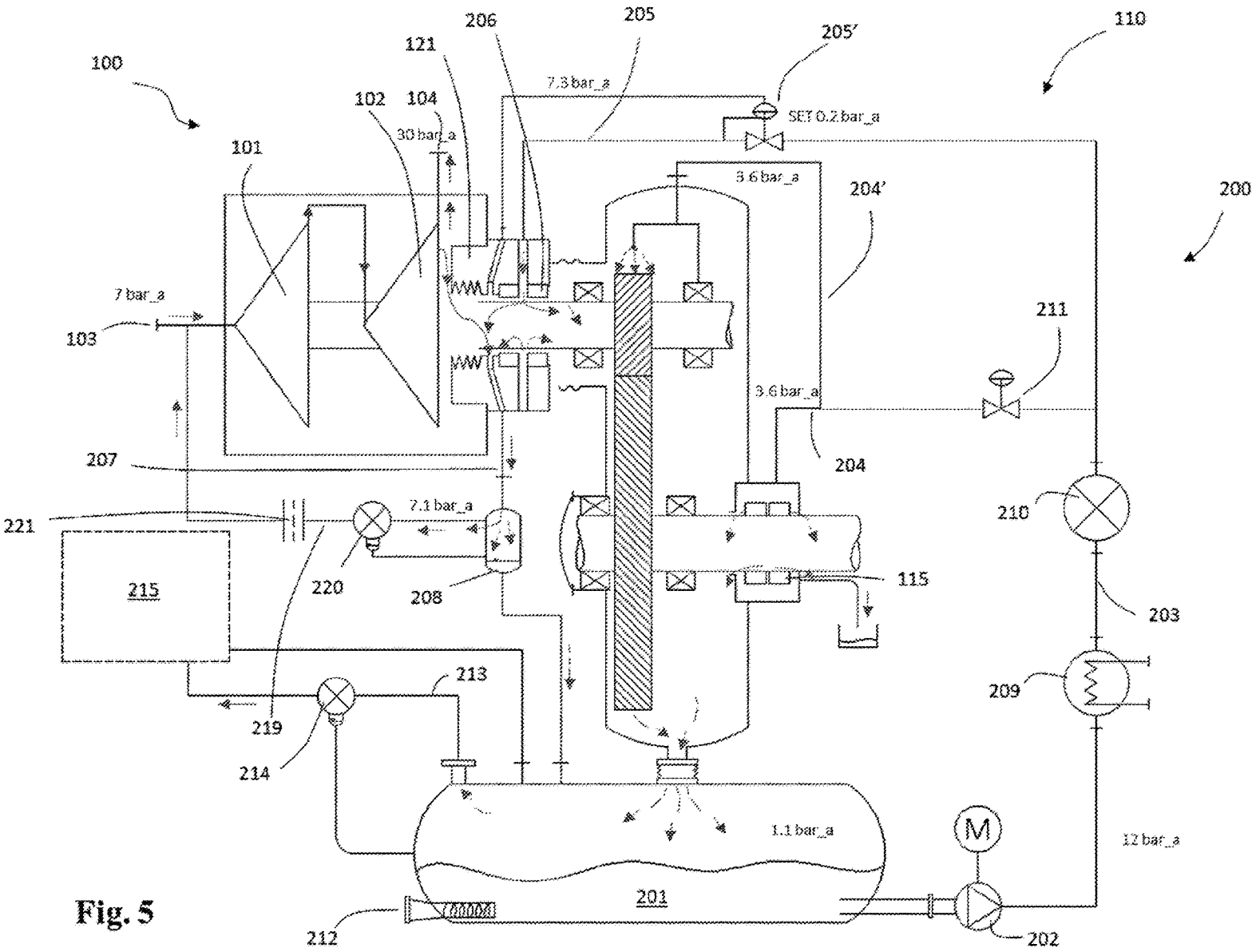
FIG. 5 is a simplified diagram of the lubrication and sealing system for the compressor of FIG. 2, in a second embodiment.

To overcome this problem, it is possible to use more sophisticated seals instead of the simple labyrinth seal, for example creeping carbon or "dry" seals or with seal rings which, by means of particular surface processes, when rotating produce a fluid dynamic lift that detaches the rings creating a fluid meatus in the order of a few microns. With reference to FIG. 5, it is also possible to add an oil seal 206 with floating rings to the labyrinth seal 121. This type of seal is advantageous as it can use the same fluid used for lubrication of the multiplier.

FIG. 5, therefore, illustrates a second embodiment of the lubrication and sealing system.

The diagram in FIG. 5 is similar to that described in FIG. 4 as regards the lubrication and mechanical seal 115 on the slow shaft while the seal on the end of the pinions changes significantly.

The delivery branch 203 is further divided into a third supply branch 205 which supplies the floating ring oil seal 206. The seal is ensured by injecting oil between two floating rings at a slightly higher pressure, for example 0.2 bar, than the pressure present in the chamber between the labyrinth seal 121 and the oil seal 206 (exhaust branch 207). The oil pressure between the rings is controlled for example by a differential regulator 205' which regulates the flow according to the pressure in said discharge branch 207 of the compressor side seal.

The oil that comes out of the floating rings is discharged into the lower pressure oil tank 201 directly via pipes or channels present in the case and via the discharge branch 207 connected to a separator vessel 208 with automatic drainer. This discharge branch 207 has a higher pressure than that of the casing 116 of the speed multiplier 110 and therefore reduces the leakage of working fluid through the labyrinth seal 121 compared to what happens using the first embodiment of FIG. 4. Therefore, this second form of implementation of the seal lubrication system increases the efficiency of the compressor 100 and improves the separation of the oil from the working fluid, especially in the case of high-pressure applications, for example with suction pressures greater than 3-4 barA.

The high pressure discharge branch 207, downstream of the oil seal 206, conducts the oil and gas drawn from the labyrinth seals 121 to the separator vessel 208 which has the function of separating the liquid from the gaseous phase, the liquid being drained to by means of an automatic drain in the oil tank 201 while the gaseous phase of the working fluid is taken from the upper part of the separator vessel 208 to be transferred via a return line 219 to an area with lower pressure, for example the suction line 103 of the compressor 100. On this return line 219 there may be devices for separating any drops of oil, for example a "demister" 220 and flow regulators such as orifices 221 and valves to limit the speed of the fluid in the pipe. An excessive speed in the pipe, for example greater than 30 m/s, compromises the function of the separator vessel 208 by dragging the drops of oil from the discharge branch 207 towards the suction of the compressor.

Level control in the separator vessel 208 with automatic drain may be provided by a float valve or by an actuated valve that opens with respect to an oil level measurement.

The automatic drainer of the separator vessel 208 prevents the gas from the compressor casing from leaking directly into the oil tank, thus pressurizing it. With this system the process fluid that is transported into the oil tank 201 is only that which remains dissolved or trapped in the discharged oil. This allows the capacity of the depressurization system 215 to be minimized with obvious advantages in terms of efficiency and cost.

The oil that is discharged from the seal 206 into the casing 116 of the speed multiplier 110, at a lower pressure than that present in the discharge branch 207, is drained together with the lubrication oil into the tank 201.

Figure 6:
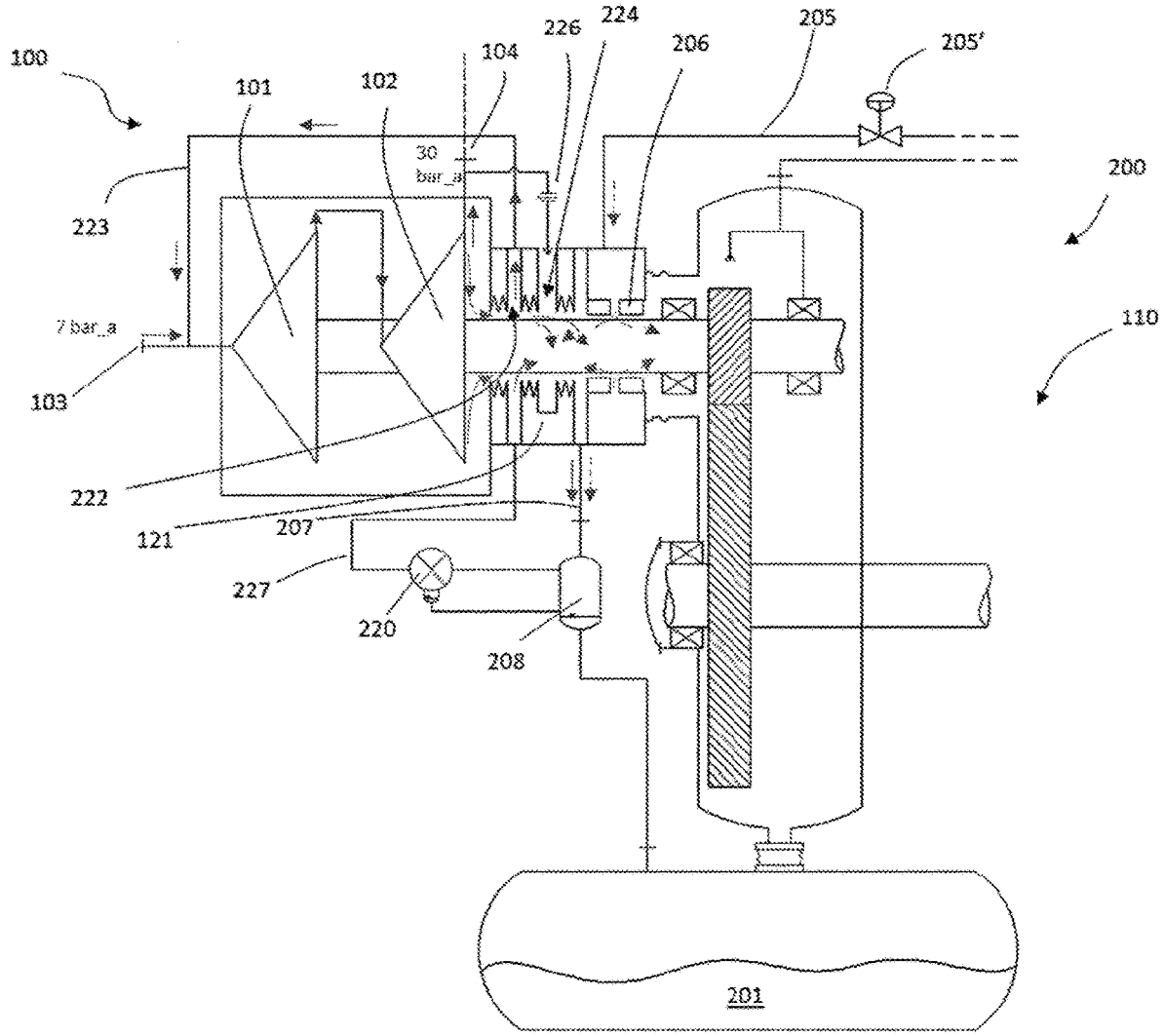
FIG. 6 is a simplified diagram of the lubrication and sealing system for the compressor of FIG. 2, according to a third embodiment.
Figure 7:
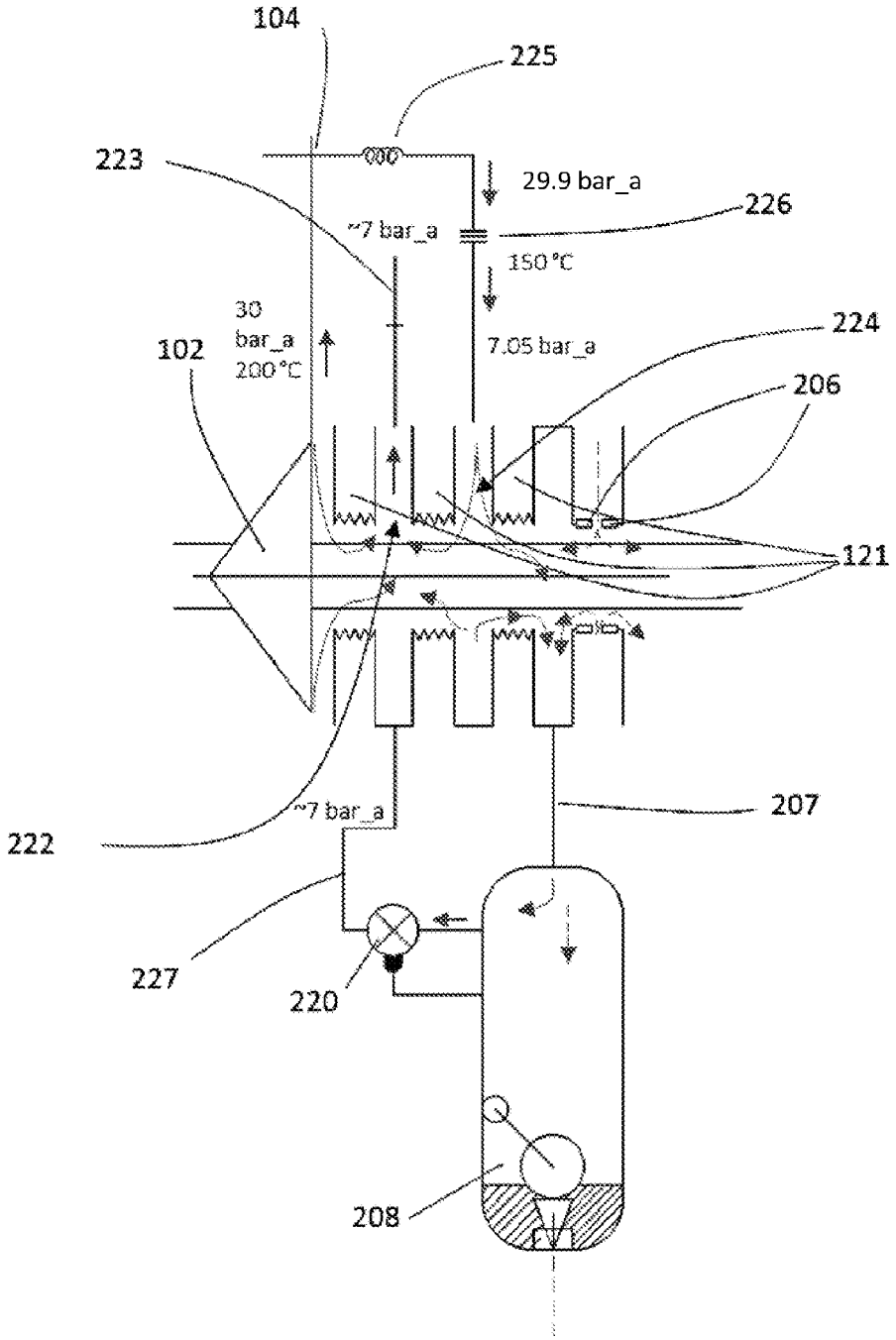
FIG. 7 is an enlarged detail of the diagram in FIG. 6.

With reference to FIGS. 6 and 7, a third embodiment of the lubrication and sealing system is now described. In these figures some components have not been represented as identical to those already described in FIGS. 4 and 5.

In particular, the solution schematized in FIGS. 6 and 7 is used if the temperature of the working fluid at the compressor delivery is very high, for example greater than 200° C., such as to exceed the maximum allowable temperature of the oil with consequent formation of sludge and carbon deposits. Furthermore, this embodiment allows the "migration of oil" towards the process to be avoided as much as possible by reducing the flow that passes through the separator.

In this configuration, completely similar to the previous one with the exception of what is described below, a vent or equalization chamber 222 is added connected via the recirculation line 223 to a relatively low-pressure area, for example the suction line 103 of the compressor, downstream of the labyrinth seals 121.

Compared to the configurations previously shown, in this case the labyrinth seals 121 are greater in number than one and between them there is an injection chamber 224 where steam of the suitably cooled process fluid is injected, for example at 150° C., from a heat exchanger 225 so as to block the hot gas and prevent it from coming into contact with the oil discharged from the oil seal 206.

To minimize the consumption of gas used to block the hot gas, a control with a sonic orifice 226 calculated to have a speed of the cooled gas, for example 15 m/s average under the labyrinth, sufficient to prevent the leakage of hot gas from the vent chamber 222, is used and to prevent the migration of any oil from the seal towards the compressor 100. Alternatively, the control can also be carried out by a valve or a calibrated hole.

This control also has the advantage of minimizing the flow rate of gas passing from the discharge branch 207 and from the separator vessel 208 with obvious advantages in the ability to prevent the migration of oil towards the process.

Figure 8:
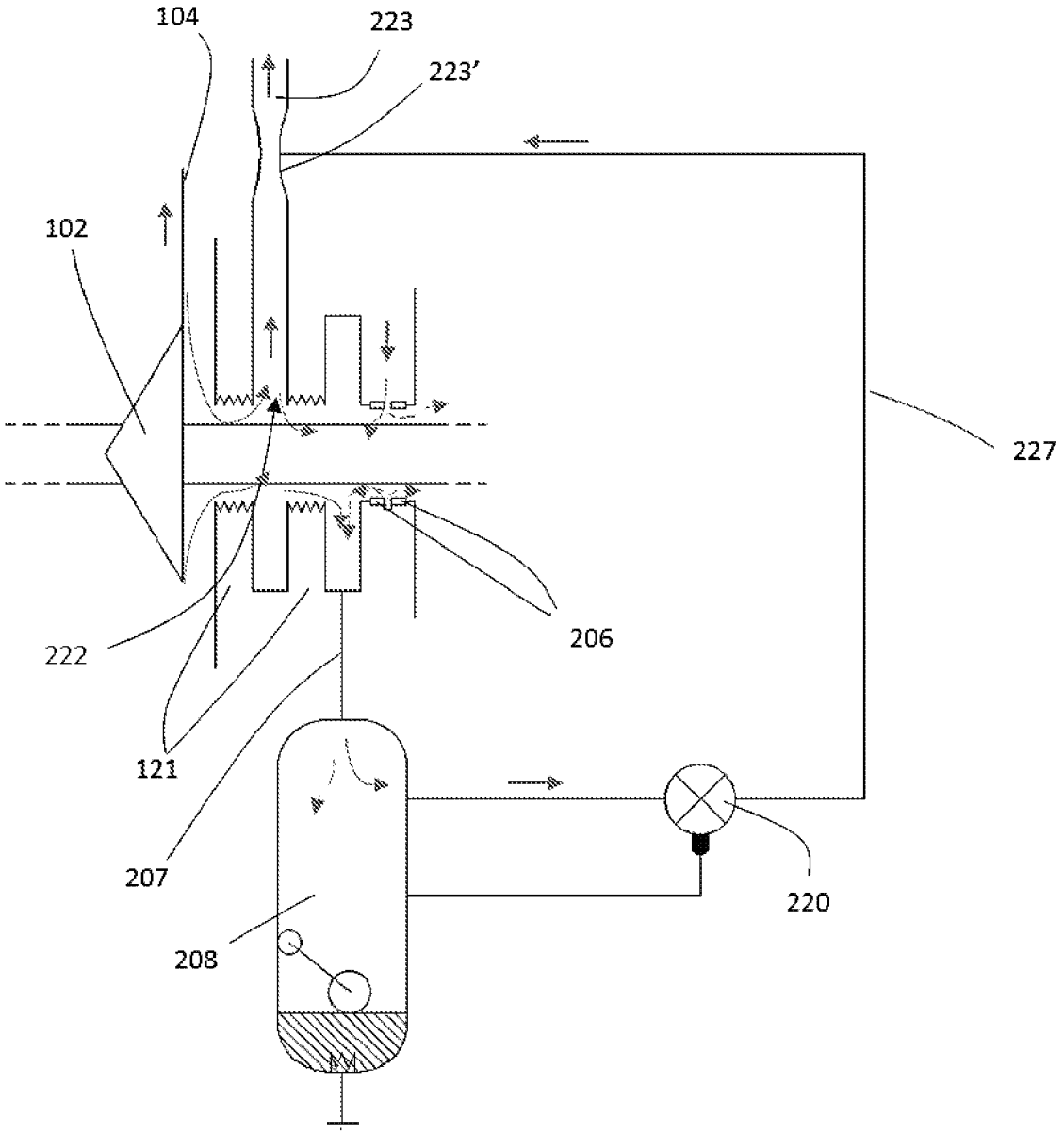
FIG. 8 is a simplified diagram of the lubrication and sealing system for the compressor of FIG. 2, according to a fourth embodiment.

By virtue of the type of flow control via sonic orifice, it is recommended to connect the return branch 227 coming from the separator vessel 208 onto the vent chamber 222 in such a way as to balance as equally as possible the division of the flow from the injection chamber 224 towards the vent chamber 222 and the discharge branch 207 of the oil seal 206. In fact, the pressure differentials that are established across the labyrinth seals with this control system are very low, in the order of hundredths of a bar, and therefore highly influenced by the design of the pressure equalization lines. With reference to FIG. 8, a fourth embodiment of the lubrication and sealing system is described which may be advantageous for minimizing the gas flow of the working fluid to the trap of the separator vessel 208, the gas flow responsible for any contamination of the process.

Therefore, this embodiment can be applied if there is a need for extremely accurate pressure regulation but without the need to create a barrier with cooled gas. The gas that leaks in a controlled manner from the vent or equalization chamber prevents the migration of any oil from the seal towards the compressor. The control over the pressure differential that regulates the flow of gas at the outlet of the labyrinth seals 121 is achieved by connecting the return branch 227 of the separator vessel 208 to the vent or equalization line 223, in a narrow section 223' where the average flow velocity is greater. In this way, a pressure differential is created between the environment upstream of the labyrinth seals 121 and section 223' that is smaller than that existing upstream of the labyrinth seals 121 by virtue of the reduction in static pressure due to the acceleration of the fluid in the section 223' (Bernoulli's principle). For example, you can have a speed of 15 m/s before the section 223' and a speed of 30 m/s in the narrow section of the section 223', reducing the passage area in the duct by a factor of 2, sufficient to generate the differential desired pressure.

Ultimately, according to the present invention, the compressor equipped with an integrated speed multiplier has a single mechanical seal towards the external environment, which requires excellent sealing, the seal mounted on the shaft with the lowest rotation speed. Therefore, the compressor solves the technical problem of reducing the number of seals and minimizing the loss of working fluid to the outside. The compressor also has a gearbox casing capable of withstanding the pressure of the compressor's working fluid while maintaining the relative position between the different pinions in tolerance. The technical problem of creating a pressurized casing with these characteristics is solved by the fact that the gearbox casing is provided with a rigid frame which supports pinions and bearings, with an external containment shell, inside which the frame is allocated, and a flexible element to allow the expansion of the containment shell without exerting excessive forces on the internal frame. Depending on the applications, i.e. the pressure and temperature values, it is then possible to use the most appropriate lubrication and sealing scheme.

In addition to the ways of implementing the invention, as described above, it should be understood that numerous further variations exist. It must also be understood that said ways of implementation are only exemplary and do not limit neither the object of the invention, nor its applications, nor its possible configurations. On the contrary, although the above description makes it possible for the skilled man to implement the present invention at least according to one of its exemplary configurations, it must be understood that numerous variations of the described components are conceivable, without thereby departing from the object of the invention, as defined in the attached claims.

The invention claimed is:

1. A compressor (100) for a working fluid having an integrated speed multiplier (110), the speed multiplier (110) comprising:

a first shaft (111), connected to a motor, carrying a gear (112), supported by first bearings (112'), at least one second shaft (113) carrying a pinion (114), arranged circumferentially around the gear (112) and connected to one or more impellers of the compressor (100), the second shaft being supported by second bearings (114'), wherein the pinion (114) and the gearwheel (112) mesh directly or indirectly with each other, a mechanical seal (115), placed on one end of the first shaft (111), and a casing (116) which contains the shafts (111, 113), the gear (112), the pinions (114), the bearings (112', 114') and the working fluid, the compressor being characterized in that the casing (116) in turn comprises:

a frame (118) which supports the first shaft (111), the gear (112), the related bearings (112'), the at least one second shaft (113) with related pinion (114) and bearings (114') and is connected via an interface element (117), to the compressor casing (116), a shell (119) for containing the pressure of the working fluid and inside which the frame (118) is located, and a flexible element (120) interposed between the interface element (117) and the pressure containment shell (119), at least one labyrinth seal (121) accommodated on each second shaft (113) and mounted between the interface element (117) and the pinion (114).

2. The compressor (100) according to claim 1, wherein the frame (118) comprises two half frames (118') and a central ring (118") to which the two half frames (118') are connected and the central ring (118") comes out of the containment shell (119).

3. The compressor (100) according to claim 2, wherein the shell (119) comprises two half-shells (119') connected to the central ring (118").

4. The compressor (100) according to claim 3, wherein the two halfshells (119') are divided along a vertical centerline and are comprised of dished ends.

5. The compressor (100) according to claim 1, wherein the flexible element (120) is a bellows or a flexible diaphragm or an elastic sealing element.

6. The compressor (100) according to claim 1, wherein the mechanical seal (115) is a single seal.

7. The compressor (100) according to claim 1, wherein the mechanical seal (115) is a double seal containing a barrier fluid.

8. The compressor (100) according to claim 1, further comprising a lubrication and sealing system (200) which comprises:

an oil tank (201), in which the separation between the liquid and vapor phases of a mixture of oil and working fluid also takes place, an oil pump (202), downstream of the tank (201) and in fluid communication with it,—an oil conditioning system, consisting of a thermostat-controlled cooling system (209), downstream of the pump (202), and a filtering system (210), located downstream of the cooling system (209), an oil pressure regulation system (211), a delivery branch (203) from the oil pump (202), which is divided into a first supply branch (204) of the oil to the mechanical seal (115) and in a second supply branch (204') which distributes the oil to the bearings and sprayers for the lubrication of the pinions (114) and the gear (112), a return line (213) which connects the tank (201) to a suction line (103) of the compressor (100).

9. The compressor (100) according to claim 8, further comprising a depressurization system (215).

10. The compressor (100) according to claim 9, wherein the depressurization system (215) comprises an ejector (216) and a regulator (217) which modulates a driving fluid (218) of the ejector (216) as a function of the pressure required in the tank (201).

11. The compressor (100) according to claim 10, wherein the tank (201) is equipped with devices suitable for separating the liquid phase and the vapor phase.

12. The compressor (100) according to claim 8, further comprising a demister (214) positioned along the return line (213).

13. The compressor (100) according to claim 8, further comprising:

a floating ring oil seal (206) with oil injection between two floating rings, fed by a supply branch (205) located downstream of the delivery branch (203), a differential regulator (205') which regulates a flow as a function of the pressure in a discharge branch (207) located downstream of the oil seal (206), a separator vessel (208) with automatic discharge located downstream of the discharge branch (207).

14. The compressor according to claim 13, further comprising a return line (219) connecting the separator vessel (208) to the suction line (103) of the compressor (100).

15. The compressor (100) according to claim 14, further comprising a demister (220) is-located along the return line (219).

16. The compressor (100) according to claim 8, further comprising at least one flow regulator is located along the return line (219).

17. The compressor according to claim 13, further comprising:

a vent chamber (222), connected via a recirculation line (223) to the suction line (103) of the compressor and located downstream of the labyrinth seals (121), an injection chamber (224) located between the labyrinth seals (121) into which gas cooled by a heat exchanger (225) is injected, a sonic orifice (226) or a valve or a gauge port for gas velocity control.

18. The compressor according to claim 17, further comprising a return branch (227) connects the separator vessel (208) with the vent chamber (222).

19. The compressor according to claim 18, wherein the return branch (227) connects the separator vessel (208) to a vent line (223).

* * * * *